United States Patent [19]

Aarseth

[11] 4,345,861

[45] Aug. 24, 1982

[54] UNIVERSAL TANK AND SHIP SUPPORT ARRANGEMENT

[76] Inventor: Harald Aarseth, Marsveien 2, N-1500 Moss, Norway

[21] Appl. No.: 96,365

[22] Filed: Nov. 21, 1979

[30] Foreign Application Priority Data

Nov. 24, 1978 [NO] Norway ..... 783969

[51] Int. Cl.[3] ..... B61D 5/06; B63B 25/16; B65D 88/74; B65D 90/06

[52] U.S. Cl. ..... 410/68; 105/358; 105/361; 114/74 A; 114/75; 220/901; 248/146; 308/72

[58] Field of Search ..... 114/74 A, 74 T, 74 R, 114/75; 410/68; 105/358, 360, 361, 362; 220/436, 437, 901; 248/146; 308/72

[56] References Cited

U.S. PATENT DOCUMENTS

| | | | |
|---|---|---|---|
| 3,459,312 | 8/1969 | Britcher, Jr. et al. | 410/68 |
| 3,766,876 | 10/1973 | Coules | 114/74 A |
| 4,013,030 | 3/1977 | Stafford | 114/74 A |
| 4,099,649 | 7/1978 | Guilhem et al. | 114/74 A X |

FOREIGN PATENT DOCUMENTS

| | | | |
|---|---|---|---|
| 673491 | 7/1979 | U.S.S.R. | 410/68 |

*Primary Examiner*—Joseph F. Peters, Jr.
*Assistant Examiner*—Howard Beltran
*Attorney, Agent, or Firm*—Nolte and Nolte

[57] ABSTRACT

A support system for large generally cylindrical tanks in ships and including four supporting devices each comprising a tank portion and a hull portion respectively secured to the tank and hull, one of the supports being fixed with respect to linear horizontal movement, another of the supports being movable only transversely of the longitudinal axis of the tank, yet another of the supports being movable parallel to the longitudinal axis of the tank and still another support being movable both parallel to and transversely of the longitudinal axis of the tank; each tank portion of each support being connected with its respective hull portion by means of a spherical joint with thermal insulation between the spherical portions of the joints.

4 Claims, 12 Drawing Figures

UNIVERSAL TANK AND SHIP SUPPORT ARRANGEMENT

Figures 1, 1A:
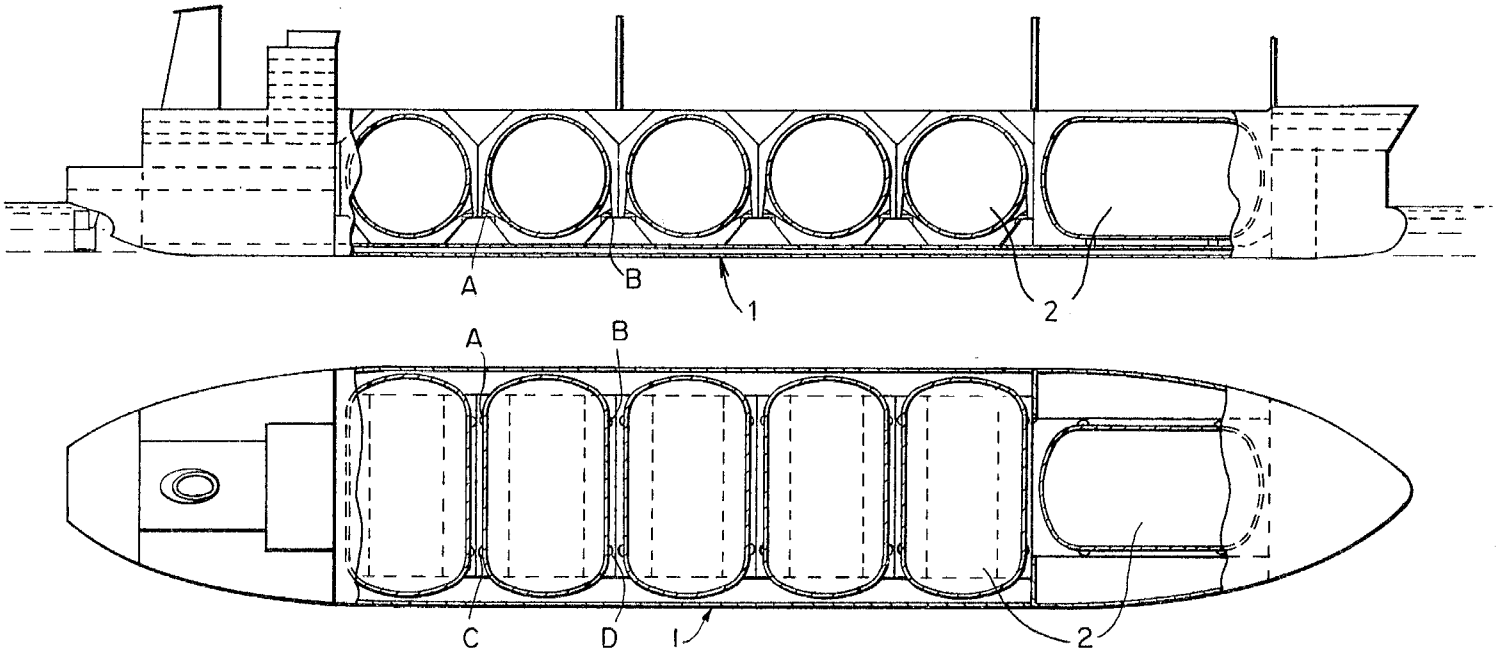

The present invention relates to a support arrangement for generally cylindrical, horisontal tanks on board ships, preferably for transportation of liquified gases at low temperature, comprising a number of supporting devices and reinforcements extending along the periphery of the tank in the area of the supporting devices.

Due to the previous not very satisfactory solutions for supporting large cylindrical tanks, for instance for transportation of LNG, cylindrical tanks have not been used on large ships, not withstanding that from the stand point of production as well as installation in ships cylindrical tanks are preferable as compared to for instance spherical tanks which hitherto have been the dominant type of independent tanks for transportation of LNG.

Cylindrical tanks have hitherto been used on ships having up to about 15,000 $m^3$ total cargo tank volume, while ships having spherical tanks for transportation of LNG have been built with up to about 130,000 $m^3$ total cargo tank volume.

For supporting cylindrical tanks in smaller existing ships it is known to use saddle supports, but for large and very large tanks this system has obvious weaknesses, for example:

Complicated transmission of forces between the ship foundation and the cargo tank. In particular large local bending moments will occur in the tank shell at the support edges, necessitating large shell thickness.

The supporting surface between the tank and ship foundation cannot be calculated with any degree of accuracy for all possible conditions and therefore there are uncertain risk that local overloading and cracking can occure in the tank material. Such risks are contrary for the strict requirements to exact calculation of stresses and fatigue relationships in the tank material by the classification societies.

It is the purpose of the invention to provide a support arrangement of the type mentioned by way of introduction, which does not have the above mentioned drawbacks and deficiencies and which, furthermore, may permit the use of cylindrical tanks in ships with a total cargo tank volume of the order of magnitude of 200,000–400,000 $m^3$.

In addition it is the purpose of the invention to provide a supporting system which is arranged so that it is statically determinate, whereby:

Fixed moments of force due to deflection of the hull, for instance in heavy sea, will not be transferred to the tanks and, furthermore, will not arise due to the avoidance of the tank bending under such forces; each of the four supports take up one or more of the occuring horizontal and vertical force components and prevent movement of the tank in the respective force directions; the system is able to absorb relative rotational and linear thermal movements without introduction of fixed moments in the supports;

the system gives good thermal insulation between the tank and surrounding hull; and the system prevents the tank from lifting if the room around the tanks should be filled with sea, water. The supporting system is characterized in that it comprises two pairs of supporting devices, each support being divided in two main parts, whereby the one part, called the "tank part" is welded to the tank at a characteristic place of the periphery and in line with the internal reinforcements of the tank, and the other part, called the "hull part" is connected to the hull, and in that the "tank part" and the "hull part" are connected to each other by means of a spherical joint, and that thermal insulation is arranged in the spherical joint between the hull part and the tank part.

In the supporting of separate tanks five liquified gases for classical technical problems must be taken into consideration and solved, namely:

1. Sufficient mechanical strength must be provided in the supports in order to transmit all existing static and dynamic forces from the cargo tanks to the hull structure.

2. Provision must be made for thermal expansion at the support due to strongly varying temperature variations in the material of the cargo tanks, while surrounding hull materials have approximately the temperature of the surrounding air and sea.

3. The supporting system must provide insulation between the cargo tank and the adjacent hull structure, since the hull materials preferably should not be dimensioned for the low temperatures of the transported cargo.

4. Transmission of forces between the hulls and cargo tanks caused by deformations of the hull in heavy sea, have to be minimized.

Complete avoidance of such inter-action is only possible in a statically determinate supporting system.

5. An arrangement which prevents free tank movement if the room around the tank should be filled with water.

Figure 3:
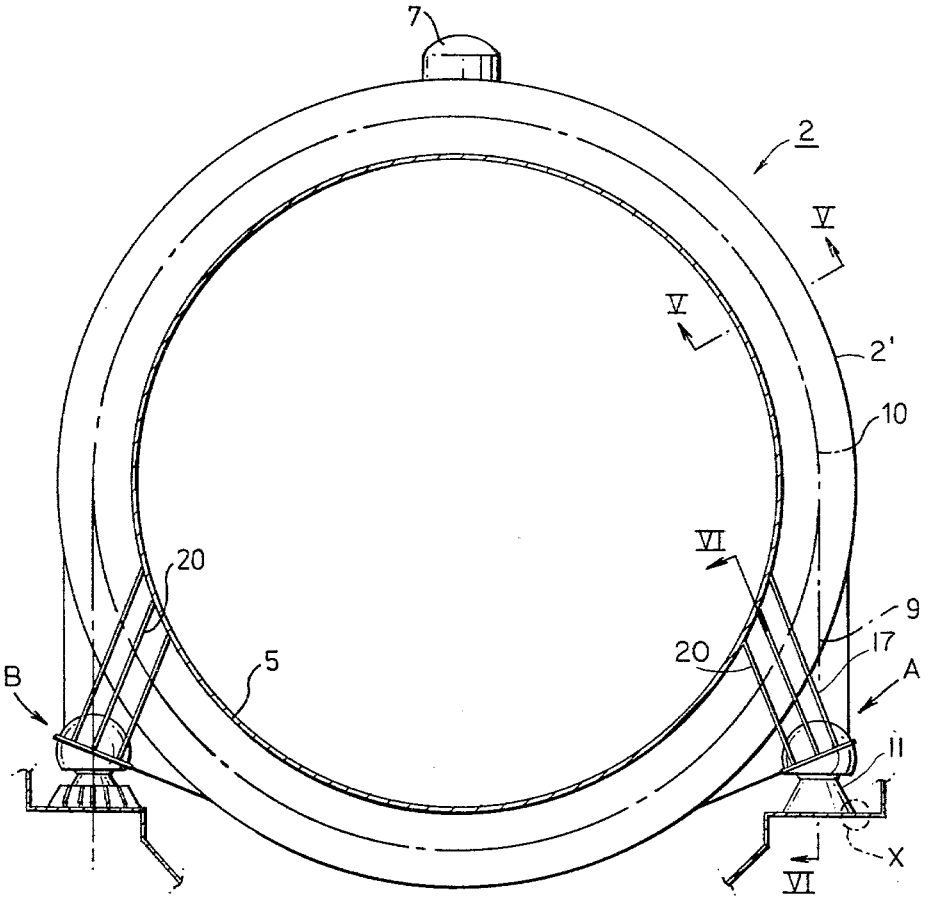
Figure 5:
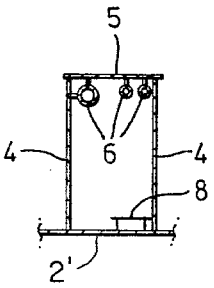
Figure 8:
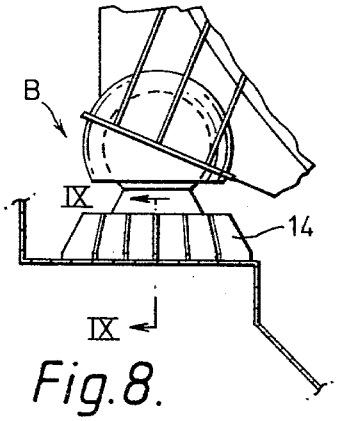
Figure 9:
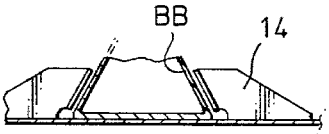
Figure 10:
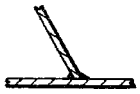
Figure 4:
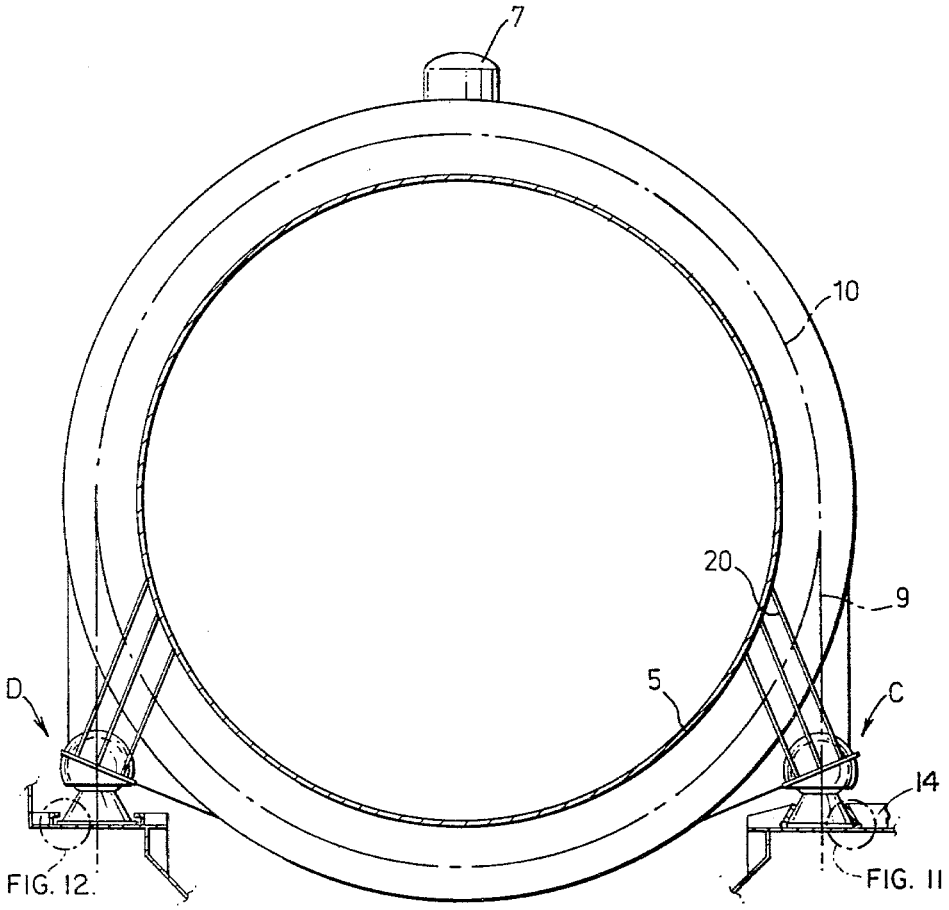
Figure 11:
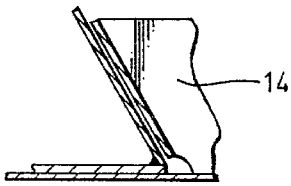
Figure 12:
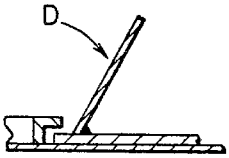
Figure 7:
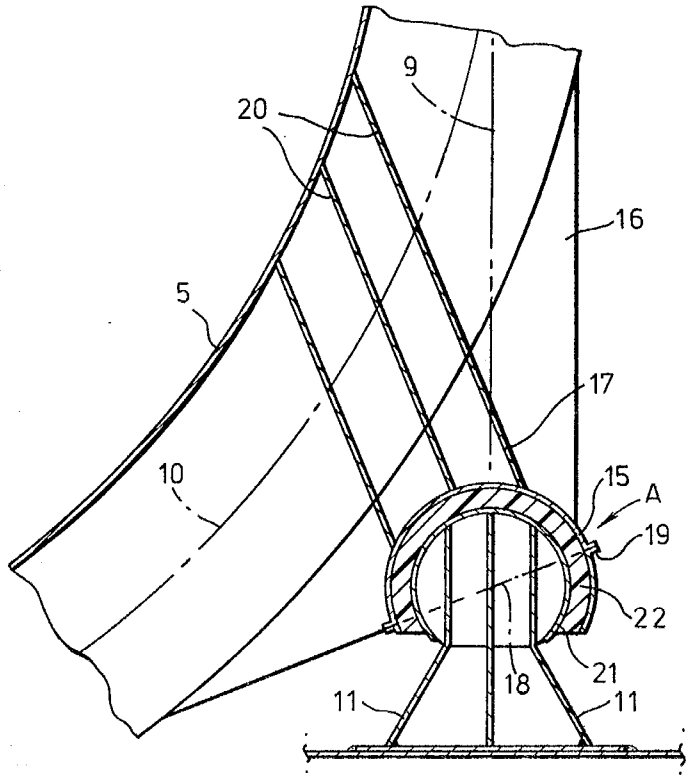
Figure 6:
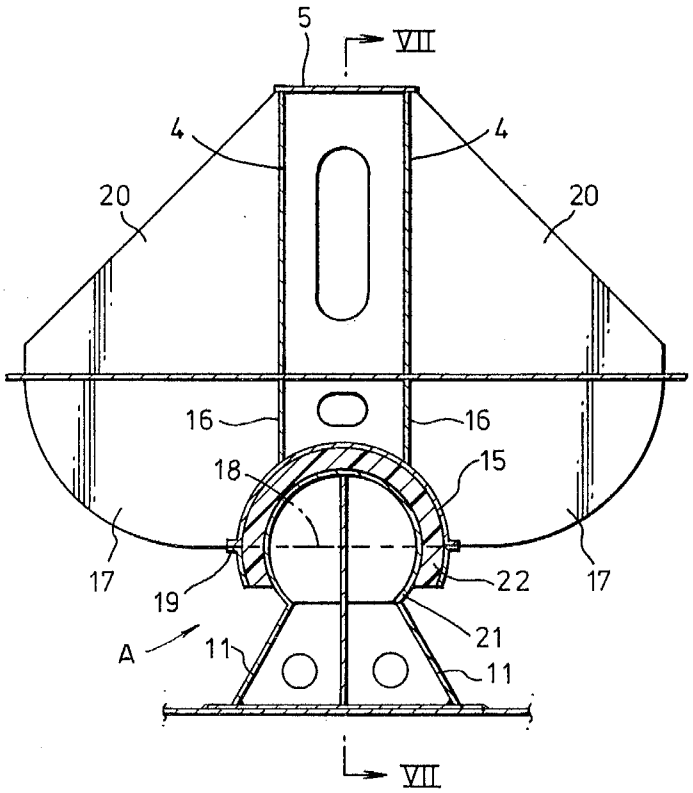

The present invention provides a solution to all these basic problems in a new and effective manner, and concurrently it provides simple production and installation of the tanks. This will be clear from the following description of the examplifying embodiment of the invention shown in the drawings, in which FIG. 1 schematic plan view and FIG. 1*a* is a side elevational view, both views being partially broken away and in section of a tanker with cylindrical tanks, FIG. 2 is a plan view of a tank supported in accordance with the invention, FIG. 3 is a partially schematic, sectional view taken along the line III—III in FIG. 2, FIG. 4 is a partially schematic sectional view taken along the line IV—IV in FIG. 2, FIG. 5 is a sectional view taken along the line V—V in FIG. 3, FIG. 6 is a sectional view taken along the line VI—VI in FIG. 3, FIG. 7 is a sectional view along the line VII—VII in FIG. 6, FIG. 8 is an enlarged view of the left support in FIG. 3, FIG. 9 is a sectional view taken along the line IX—IX in FIG. 8, FIG. 10 is a sectional view of a detail marked X in FIG. 3, FIG. 11 is a sectional view of a detail marked XI in FIG. 4, FIG. 12 is a sectional view of a detail marked XII in FIG. 4.

The tanker shown in FIG. 1 is provided with six horizontal cylindrical cargo tanks 2. Five of these have the longitudinal axis oriented laterally while the longitudinal axis of the sixth is oriented longitudinally.

Figure 2:
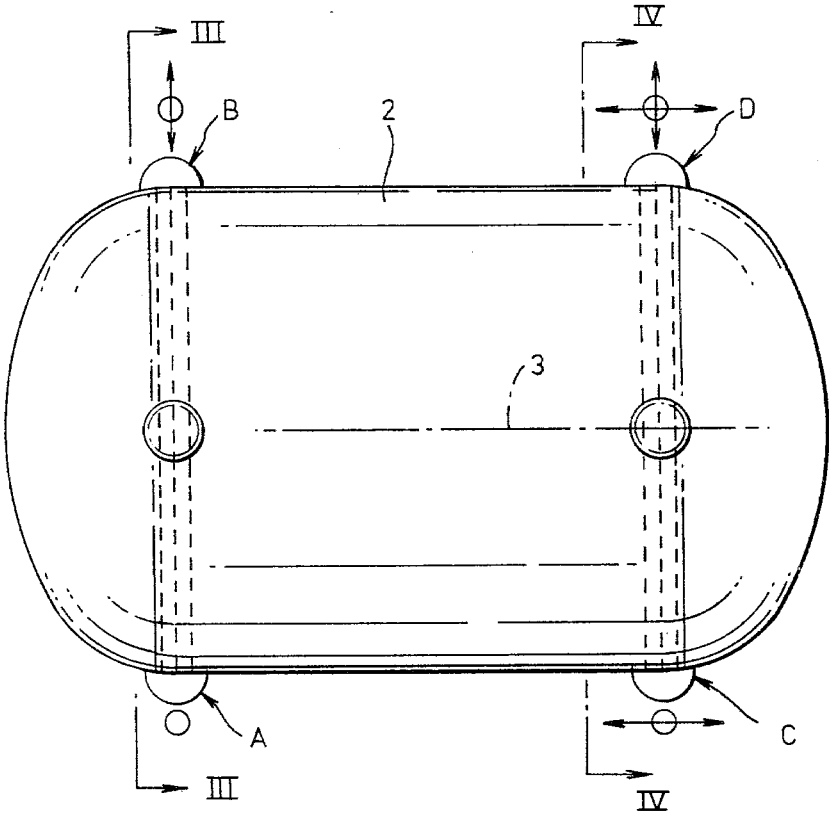

As shown in FIG. 2, each tank is supported on a system of four supports which are designated A, B, C and D, respectively, and which are arranged two and two at opposite ends of the tank. In the embodiment shown the supports are arranged in order to provide technical solutions to the five classical problems stated above, and as a result of this each support is given different functions.

This characteristic distribution of functions according to the invention is indicated in the tables below.

TABLE 1

| | Transmission of forces | | | | |
|---|---|---|---|---|---|
| | Reaction forces | | | Filling of cargo room | Interaction hull/tank |
| Support type | Vertical | Transverse | Longitudinal | with sea water | due to hull deformations |
| A | + | − | + | + | − |
| B | + | + | − | + | − |
| C | + | − | + | + | − |
| D | + | − | − | + | − |

TABLE 2

| | Thermal expansion and insulation | | |
|---|---|---|---|
| | Thermal expansion | | Thermal |
| Support type | Linear | Rotation | insulation |
| A | − | + | + |
| B | + | + | + |
| C | + | + | + |
| D | + | + | + |

Free rotation, or expressed in an other way, avoidance of fixed moments at the supports, in according to the invention obtained for all occurring load possibilities, namely:

By a change in the diameter of the tank due to changes in temperature in the tank material.

By static and dynamic bending loading of the tank due to its own weight.

For these two cases and as shall be described more in detail, the tank part or outer portion of the spherical support (shell 15 and plates 17; see FIGS. 6 and 7) will rotate, while the hull part, or inner portion of the spherical joint support (shell 21 and bracket 11; see FIGS. 6 and 7) will not be affected.

By deformations of the hull beams, for instance in heavy sea, the hull part of the support will rotate in the spherical joint, while the tank part will not be affected.

By the avoidance of interaction between hull and tank as described above, the following very important advantages are obtained:

Less risk of crack formation in the tank and the grave consequences this can have, in that simpler and safer stress and fatigue analysis of the tank material is possible.

Avoidance of substantial local reinforcements in the tanks in order to compensate for additional loads.

As it will be seen from the tables, all supporting points provide thermal insulation (inserts 22, see FIGS. 6 and 7) between the tank and the ship. Furthermore, all supports permit rotation of the tank with respect to the attachment for the supports in the ship, and vice versa.

All supports, except for A (as shall be more fully exlained) permit linear thermal expansion, but in different ways, as it is indicated with arrows at each of these in FIG. 2. Thus, support B will only permit thermal movements transversely of the longitudinal axis 3 of the tank 2. Support C permits thermal motion parallel to the longitudinal axis of the tank, while support D permits thermal motion both transverse of and along the longitudinal axis. When the cargo tank 2 contracts or expands during cooling and warming, the tank is guided by the permit ted movements of supports B, C and D, so that its longitudinal axis 3 undergoes parallel displacement while support A stays at rest.

All supports are able to take up vertical forces.

As it best appears from FIGS. 3 and 5, the tank 2 is reinforced internally of its outer shell 2' (shown schematically in FIGS. 3, 4, 7 and 8) at the supports by means of a system of ring web plates 4 with a flange plate 5. The rooms thus formed may advantageously be used for running of lines 6 for product, electric power, flushing gas etc., and for access to the bottom of the tank from a dome 7, for instance by means of a ladder 8. The dimensions of this reinforcing system is dependent upon the occuring outer forces and any bending moments. The magnitude of such bending moments caused by vertical reaction forces will be dependent upon the location of the supports with respect to the periphery of the tank. According to the invention the supports are placed so that the direction 9 of the vertical force generally becomes tangent to the circumferential neutral axis 10 of the reinforcing system which, as can be seen in FIG. 3, is central of and parallel to the outer shell of the tank 2' and flange 5. The occurring outer bending moments due to vertical forces will therefore be reduced to a minimum.

Due to the possible careening and rolling of the ship, the support system is arranged to take up transverse forces. Furthermore, it is arranged so that the reaction forces and moments which are transmitted to the tank structure, give the least possible consequences with respect to local reinforcement of the tank structure. With the supports located as shown, the external bending moment to which the tank is subjected, is thus of limited magnitude. As is apparent from FIG. 2 and the preceding table, the supports A and B in the shown embodiment are able to take up transverse forces.

Since support A does not have to permit linear thermal relative motion, the ability to take up transverse forces from the tank is quite simply obtained by welding the hull part of the support directly to the hull structure as seen in FIG. 10 or preferably as seen in FIG. 6, to a base plate which is welded to the hull structure. Support B must give the possibility of longitudinal thermally related movement. As is apparent from FIGS. 8 and 9, this is obtained by means of a slide system between the hull part of the support comprising plates 14 and elements forming natural parts of the hull and welded. Plate elements 14 and welded to the hull which prevent the tank from moving in an undesired direction, while permitting sliding movement of the support base BB in FIG. 9, between the plates 14.

In order to reduce the frictional forces during sliding, a lubrication system may be arranged in the sliding surfaces or inserts of materials having a low coefficient of friction may be interposed. It should be noted that such gliding movement will take place during cooling of the tank, i.e. when the tanks are practically empty, so that the frictional forces occurring will be of relatively modest magnitude.

Due to the ship's motion in sea and possible impacts against docks or the like, the tanks are anchored so that they can take up longitudinal dynamic forces. As is apparent from FIG. 2 and the previous table 1, this function is performed by the supports A and C.

For supports C, as is apparent from FIGS. 4 and 11, this is obtained much the same as for support B, except that the elements 14 are oriented 90° differently in the horisontal plane with respect to the position which is shown in FIGS. 8 and 9.

Support D is in principle shown in FIG. 12, wherefrom it is seen that the hull part of the support can slide freely against the hull structure in both horizontal directions.

Free rotation or avoidance of fixing moments at all supports are, as previously mentioned, according to the invention obtained by the introduction of a spherical joint between the hull part and the tank part of each support.

Solutions are shown in FIGS. 6 and 7 and are identical for all supports, and are characterized by a spherical joint consisting of two consentric spherical shells which are separated by means of an insulating insert, and by that the centre of the spherical shells lie on the vertical tangents to the neutral axis of the reinforcements.

The upper spherical shell is welded to the external plates on the tank and together with these form the tank part of the support. The material in the entire tank part may advantageously be the same as for the remainder of the tank.

Due to installation considerations the spherical shell 15 is divided into two elements along the central plane 18, and the parts are bolted to each other at the flange 19. The plates 16 lie in the same plane as the internal web plates 4 and serve mainly to transmit vertical forces.

The plates 17 lie in the same plane as the internal reinforcing plates 20 and serve mainly to transmit forces which are parallel to the longitudinal axis of the tank 2.

The second spherical shell 21 has the same center as the first spherical shell 15. It is welded to a bracket system 11 consisting of plates welded together and form the hull part of the support.

Between the outer spherical shell 15 and the inner spherical shell 21 a thermally insulating insert 22 is arranged and thus defined by the two consentric spherical surfaces, having sufficient pressure resistance in order to withstand all occurring forces. For installation considerations this insert also is divided along the central plane 18. PTFE may be an example of such thermally insulating and pressure resistant material.

Between the spherical shell 15 and the insert 22 a thin layer of stainless steel may be arranged in order to reduce heat leakage through the support system.

Since the temperature in the inner spherical shell 21 and the bracket system 11 will be much higher than in the tank 2, the material in the shell 21 and the system 11 can be of a much less ductile, and thereby cheaper, quality than in the tank 2.

By arranging the spherical joint as shown in FIG. 6 and FIG. 7 and described above, the system will also to a sufficient degree be able to take up vertical, upwardly directed forces and thereby prevent lifting of the tank 2 if the room around the tank should be filled by sea water.

Rotational movements or free angular changes at the supports will be taken up as sliding movement between the spherical shell 21 and the insert 22.

The tank 2 itself and the elements 15, 16 and 17 will be insulated, while the bracket system 11 and the inner spherical shell 21 will not be insulated. In this way all "cold" surfaces will have continuous insulation, resulting in minimum heat leakage. The thermally insulated support thus provided gives small heat leakage from the ship to the tank and, furthermore, entails minimal use of cryogenic materials outside the tank itself.

I claim:

1. A system for supporting a large, generally cylindrical horizontal tank on a carrier and for accommodating movements of the tank due to thermal contraction and expansion and carrier movements comprising four supports arranged fore and aft of the tank and on each side of the longitudinal axis thereof, said four supports having tank portions rigidly secured to the tank and carrier portions mounted to the carrier by means rigidly securing the carrier portion of one said support to said carrier and slidably connecting the carrier portions of the other three said supports to the carrier for horizontal movement of the tank and said three supports relative to the carrier, and spherical ball and socket joint means interposed between said tank and carrier portions of said supports for accommodating relative movement between said tank and carrier portions of said supports.

2. A system for supporting a large, generally cylindrical tank in the hull of a ship positioned with its longitudinal axis parallel with the horizontal, and for accommodating movements of the tank due to thermal expansion and contraction and to movements of the ship, said system comprising means extending around the periphery of the tank for reinforcing the same, means in vertical alignment with said reinforcing means for supporting the tank, said supporting means comprising four support elements, two of which are positioned in laterally spaced relation toward one end of the tank and two of which are positioned in laterally spaced relation toward the other end of the tank, each support element comprising a tank portion and a hull portion, means for rigidly securing each said tank portion to the tank, means for rigidly securing the hull portion of a first said support element to the hull, means for slidably connecting the hull portion of a second said support element to the hull, transversely spaced from the first mentioned support element for movement of the second support element only in transverse directions relative to the axis of the tank, means for slidably connecting the hull portion of a third support element to the hull longitudinally spaced from said second mentioned support element for movement of the third support element only in directions parallel to the longitudinal axis of the tank and means for slidably connecting the hull portion of a fourth said support element transversely spaced from said third mentioned support element for movement of the fourth element in both transverse and parallel directions, the tank portions of each support element being connected with its respective hull portion by spherical joint means for rotational movement therebetween, and thermal insulation being provided between the parts of said spherical joint.

3. The support system according to claim 2, wherein the center of each spherical joint lies substantially on a vertical tangent to the neutral axis of said reinforcing means.

4. The support system of claim 2 in which the spherical joints comprise socket and ball joint parts and the socket parts of each spherical joint are supported on respective tank parts, span a space angle which is greater than a hemisphere.

* * * * *